US007229278B1

(12) United States Patent
Newberry

(10) Patent No.: US 7,229,278 B1
(45) Date of Patent: Jun. 12, 2007

(54) FLAME QUALITY AND FUEL CONSUMPTION MONITORING METHODS FOR OPERATING A PRIMARY BURNER

(75) Inventor: Richard D. Newberry, Huntington, MA (US)

(73) Assignee: Carlin Combustion Technology, Inc., East Longmeadow, MA (US)

( * ) Notice: Subject to any disclaimer, the term of this patent is extended or adjusted under 35 U.S.C. 154(b) by 108 days.

(21) Appl. No.: 10/812,431

(22) Filed: Mar. 30, 2004

Related U.S. Application Data

(63) Continuation-in-part of application No. 10/053,972, filed on Jan. 22, 2002, now abandoned.

(60) Provisional application No. 60/264,209, filed on Jan. 25, 2001.

(51) Int. Cl.
*F23N 5/08* (2006.01)

(52) U.S. Cl. ..... 431/79; 431/72; 237/2 A

(58) Field of Classification Search ..... 431/79, 431/78, 76, 75, 72; 237/2 A; 340/578, 577; 250/554; 236/10
See application file for complete search history.

(56) References Cited

U.S. PATENT DOCUMENTS 4,410,266 A * 10/1983 Seider ..... 431/79
4,502,625 A * 3/1985 Mueller ..... 236/11
4,644,173 A 2/1987 Jeffers ..... 250/554
5,126,721 A 6/1992 Butcher et al. ..... 340/578
5,249,954 A * 10/1993 Allen et al. ..... 431/76
5,277,575 A * 1/1994 Newberry ..... 431/24
5,480,298 A * 1/1996 Brown ..... 431/79
5,971,747 A * 10/1999 Lemelson et al. ..... 431/12
6,113,384 A * 9/2000 Sebastiani ..... 431/12

FOREIGN PATENT DOCUMENTS

JP 1-312319 A * 12/1989
WO WO 2006/019436 A1 * 2/2006

OTHER PUBLICATIONS

"Advanced Flame Quality Indicator Offers Potential Savings for Cleaner Combustion" The Brookhaven National Laboratory, Aug. 1997 (Reproduced from Aug. 1997 Yankee Oilman Magazine.)
"Insight Advanced Flame Quality Indicator" 1996 Insight Technologies, Inc.

* cited by examiner

*Primary Examiner*—Josiah C. Cocks
(74) *Attorney, Agent, or Firm*—McCormick, Paulding & Huber LLP

(57) ABSTRACT

A control system for controlling an oil or gas burner heating system comprises an ultraviolet flame sensor. Flame is detected and preanalyzed by the control for flame quality factors reflecting the degree of drift from optimal operating conditions including the average flame intensity, and the peak intensity frequencies. Other sensors detect other drift indications including exhaust-gas-stack temperature. A modem can automatically transmit data to a remote computer used by fuel providers and service personnel or upon a call request from the personnel to the control. Software installed in the remote computer calculates the next fuel delivery date and next servicing date based on data transmitted from the control system and from the service personnel.

6 Claims, 3 Drawing Sheets

FLAME QUALITY AND FUEL CONSUMPTION MONITORING METHODS FOR OPERATING A PRIMARY BURNER

CROSS REFERENCE TO RELATED APPLICATIONS

This application is a continuation-in-part application of U.S. application Ser. No. 10/053,972, filed on Jan. 22, 2002 now abandoned, which claims the benefit of U.S. Provisional Application No. 60/264,209, filed on Jan. 25, 2001, the disclosures of which are herein incorporated by reference in their entirety.

FIELD OF THE INVENTION

The present invention relates generally to heating systems, and more particularly, to an electronic control system for controlling the operation of a burner igniter, fuel pump/air fan motor, and fuel valve used in a combustible fuel based heating system. Additionally, telecommunication of system operating conditions to remote electronic data processing locations is incorporated into this control system, for the purpose of improving the heating system serviceability, and reducing both service and fuel delivery expense.

BACKGROUND OF THE INVENTION

Most homes, businesses, and other dwellings have some type of heating system which includes some sort of heating system that is safely shutdown should the heater flame be lost or inadequate for continued safe and efficient operation. There are several methods of sensing flame in a combustion based heating system such as, for example, various light spectrum sensors, sensors of conducted heat, and sensors of ionized gaseous products of combustion. Light spectrum sensors generally detect a specific range of frequencies within the electromagnetic spectrum such as infrared, visible light and ultraviolet light. Proper detection of flame requires that the radiation detected correlates with the presence of flame—and only flame. A drawback with visible and infrared sensors is that they usually detect the afterglow of the fuel combustion chamber—in addition to flame—so as to be imprecise in determining when flame is lost. Another drawback with visible spectrum light detection involves its tendency to pick up stray ambient light. Yet another drawback with visible and infrared sensing of flame is a comparatively poor detection of flames from combusting gaseous fuel.

Ultraviolet (UV) flame sensors have broader application without the above-mentioned drawbacks with infrared and visible light sensors. However, most UV sensors used for flame sensing have the drawbacks of high operating voltages, and nonlinear correlation of signal generated to flame intensity received. The high operating voltage requires more expensive safety protection measures. The nonlinear flame to signal correlation requires more complex signal manipulation and analysis, which usually results in greater expense and reduced accuracy.

Conventional heating systems generally are periodically tuned by skilled personnel, either as needed, or on a predetermined schedule (typically annually). The 'as needed' conditions generally involve a response to an obvious malfunctioning of the heating system by the end user of this heating equipment. This mode of malfunction detection is usually very erratic, involves detection most often by unskilled observers, and frequently results in heating equipment needing extensive servicing. Periodic scheduled servicing is generally done annually. Most often, however, the average heating system receives this scheduled service more frequently than is necessary for continued safe and efficient operation. This equates to excessive service expense.

Another aspect to conventional combustible fuel based heating systems involves the need to periodically replenish the fuel for continued operation. Conventional procedures for fuel replenishment generally involve either delivery-on-demand by the personnel overseeing the heating system, or, more often, by estimations by the fuel dealer of when the specific heating system will be needing additional fuel. The later estimates are usually based on the history of the particular heating system, along with analysis of probable fuel usage based on the record of daily outdoor temperatures. These fuel usage estimates are usually very inaccurate (typically about 25% in error). Additionally, the negative effects of having a customer run out of fuel, coupled with this inaccurate usage estimation procedure combine to motivate fuel dealers to factor in a significant margin of remaining customer fuel at the time of delivery. This equates to more frequent deliveries of fuel than desirable, resulting in greater fuel delivery expense.

SUMMARY OF THE INVENTION

In a first aspect of the present invention, a control system for a heating system including a combustion chamber, a thermostat, an igniter, an air blower, and a fuel pump comprises at least one ultraviolet (UV) sensor to be positioned adjacent to a combustion flame source in the combustion chamber of a heating system for generating a UV detection signal indicative of the quality of the combustion flame based on the characteristics of UV light generated by the combustion flame. A monitoring circuit communicating with the at least one UV sensor for generating at least one signal in response to the UV detection signal.

In a second aspect of the present invention, a control system for a heating system including a combustion chamber, a thermostat, an igniter, an air blower, and a fuel pump comprises at least one ultraviolet (UV) sensor to be positioned adjacent to a combustion flame source in the combustion chamber of a heating system for generating analog signals indicative of the quality of the combustion flame based on the characteristics of UV light generated by the combustion flame. Provided is means communicating with the at least one UV sensor for converting the analog signals into digital signals indicative of the quality of the combustion flame based on the characteristics of UV light generated by the combustion flame, and means for performing numerical and logical operations on the digital signals.

In a third aspect of the present invention, a control system for a heating system including a combustion chamber, a thermostat, an igniter, an air blower, and a fuel pump comprises at least one ultraviolet (UV) sensor to be positioned adjacent to a combustion flame source in the combustion chamber of a heating system for generating signals indicative of the quality of the combustion flame based on the characteristics of UV light generated by the combustion flame. Provided is means for transmitting the signals to a remote processor via a global communications network, and means at the remote processor for employing data carried by the transmitted signals to aid service personnel responsible for fuel delivery or heating system repair in servicing the heating system.

In a fourth aspect of the present invention, a method of controlling a heating system including a combustion chamber, a thermostat, an igniter, an air blower, and a fuel pump comprises the steps of positioning at least one ultraviolet (UV) sensor adjacent to a combustion flame source of a combustion chamber of a heating system. Detection signals are generated from the at least one UV sensor indicative of the quality of the combustion flame based on the variation in the percentage of carbon dioxide present in the combustion product of the combustion flame. Such detection signals are analyzed and software modified so as to more precisely linearize the correlation between said signal and the percentage of carbon dioxide present in the flame combustion products. Control signals are generated in response to the UV signals for regulating the quality of the combustion flame.

In a fifth aspect of the present invention, a control system for a heating system including a combustion chamber, a thermostat, an igniter, an air blower, and a fuel pump comprises at least one ultraviolet (UV) sensor to be positioned adjacent to a combustion flame source in the combustion chamber of a heating system for generating analog signals indicative of the quality of the combustion flame based on the characteristics of UV light generated by the combustion flame. Provided is means of detecting, prior to system startup, whether the air blower/fuel pump power redundant switching means are operating properly, and disabling the system should either switch have a malfunction detected, such that the switch is on when it should be off.

In a sixth aspect of the present invention, a control system for a heating system including a combustion chamber, a thermostat, an igniter, an air blower, and a fuel pump comprises at least one ultraviolet (UV) sensor to be positioned adjacent to a combustion flame source in the combustion chamber of a heating system for generating analog signals indicative of the quality of the combustion flame based on the characteristics of UV light generated by the combustion flame. Provided is a simple means of detecting a telephone-in-use state, prior to telecommunication initiation, without the need for going 'off hook', and creating noise on the telephone line that may be in use for voice, fax, or other telecommunications purposes.

In a seventh aspect of the present invention, a control system for a heating system including a combustion chamber, a thermostat, an igniter, an air blower, and a fuel pump comprises at least one ultraviolet (UV) sensor to be positioned adjacent to a combustion flame source in the combustion chamber of a heating system for generating analog signals indicative of the quality of the combustion flame based on the characteristics of UV light generated by the combustion flame. Provided is means of detecting two unrelated line voltages by use of one optoisolating device.

An object of the present invention is to employ an ultraviolet sensor that changes in electrical conductivity in a predetermined way to changes in ultraviolet light emanating from the heating system's flame. The combination of a particular type of UV sensor, and an interface electronics circuit of particular design, results in a uniquely well-correlated flame intensity to flame detection signal.

A second object of the present invention is to use a low voltage flame sensor so as to simplify the hardware design, reduce cost, and to improve safety.

A third object of the present invention is to have a means of flame detection which responds quickly to the presence of flame while being far less sensitive to extraneous heat and light sources than most conventional means of flame detection.

A fourth object of the present invention is to detect and analyze heating system performance so as to determine when sufficient performance deterioration has occurred so that service is recommended.

A fifth object of the present invention is to automatically communicate operating conditions to a central remote computer so as to allow the heating system servicing agent to set a servicing schedule that adapts to the actual need for service. This would minimize service calls so as to minimize the chances of seriously poor operating conditions and expensive repairs.

A sixth object of the present invention is to automatically telecommunicate the need for immediate servicing, should the heating system become nonoperational.

A seventh object of the present invention is to accurately monitor the amount of fuel consumed by a simple and inexpensive means of tracking fuel usage time via fuel valve "on" time, along with characterizing each particular heating system's rate of fuel delivery.

An eighth object of the present invention is to automatically communicate this fuel usage to a central remote computer so as to allow the heating system servicing agent to set a fuel-restocking schedule that adapts to the actual need for fuel. This would minimize fuel deliveries, with subsequent reduction in delivery expense, while additionally avoiding running out of fuel.

A ninth object of the present invention is to monitor the temperature of the exit gases of combustion after the transfer of their heat to the medium being heated in this system. By tracking the drift of this temperature over time, measured after stabilization during each call-for-heat, system heat transfer efficiency can be tracked.

A tenth object of the present invention is to automatically communicate exit gas temperatures to a central remote computer so as to allow the heating system servicing agent to set a servicing schedule that adapts to the actual need for service. This would minimize service calls for problems related to operating conditions and expensive repairs.

An eleventh object of the present invention is to disable the power output of this control should the redundant output switch become defective by an improved means of detecting said faulty switch action, by a method that does not use an undesirable sensing current to the normally off power output terminal.

A twelfth object of the present invention is to simplify the sensing of multiple line voltage inputs by means of using opposite polarity optoisolator drive currents from two line voltage sources into one optoisolator.

A thirteenth object of the present invention is to modify the means of sensing a modem's incoming call, so as to allow the circuit to also sense modem phone line usage by other users, without the nuisance to these users of said modem going off-hook to examine line usage.

DETAILED DESCRIPTION OF THE PREFERRED EMBODIMENT

Figure 1:
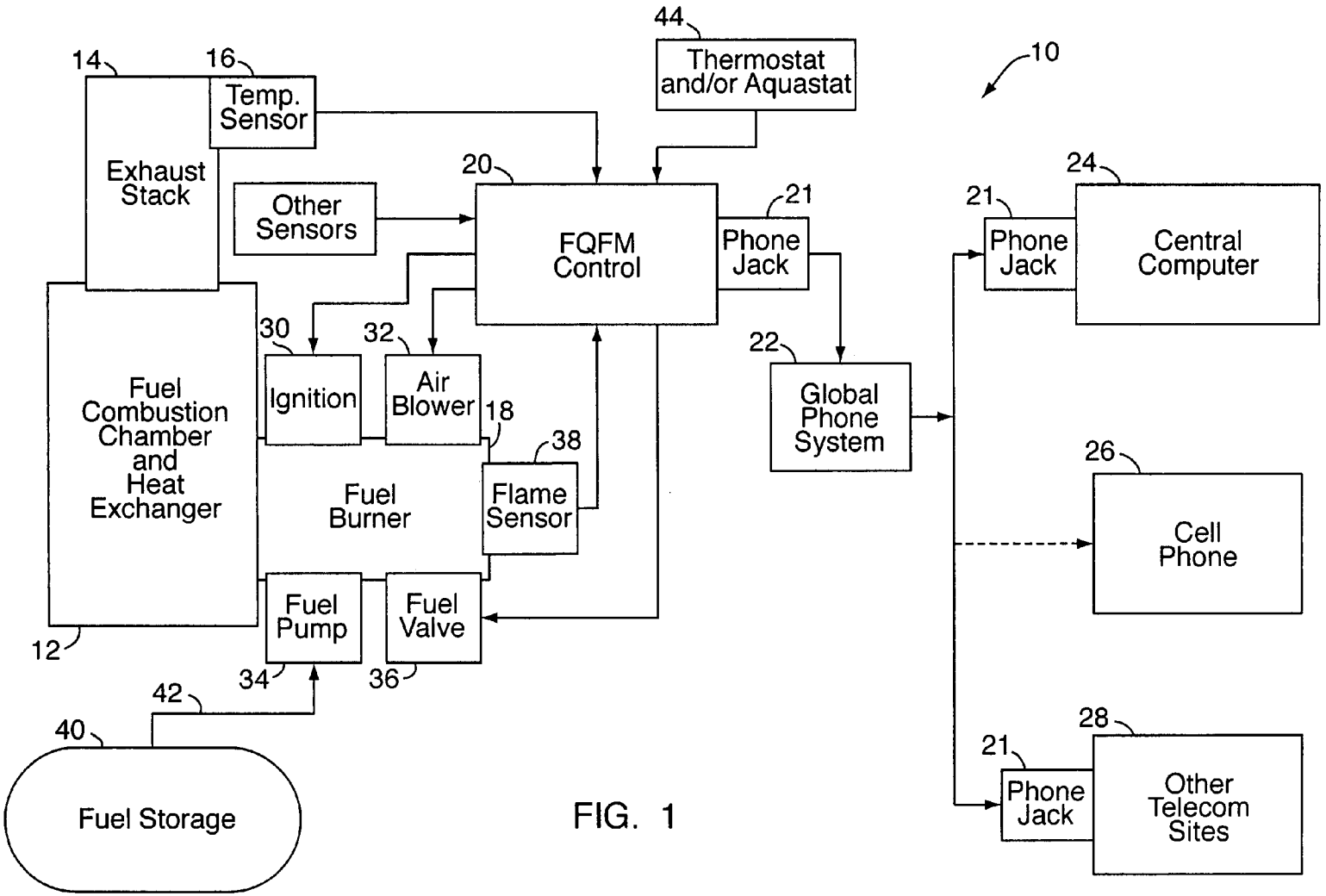
FIG. 1 is a block diagram of a flame quality and fuel monitoring (FQFM) heating system embodying the present invention.

With reference to FIG. 1, a heating system embodying the present invention is generally designated by the reference number 10. The system 10 may, for example, be associated with an oil or gas fired system for a steam, hot water, or forced air system. However, it should be understood that the heating system 10 may be incorporated with other suitable systems without departing from the scope of the present invention.

The heating system 10 includes a fuel combustion chamber/heat exchanger 12, having an exhaust stack 14 and a stack temperature sensor 16 coupled thereto. A fuel burner 18 is regulated by a control system 20. Data received by the control system 20 may be transmitted to remote locations for alerting or otherwise informing service personnel of burner operating conditions. For example, as shown in FIG. 1, data from the control system 20 may be transmitted via a global communication system, such as, for example, a phone jack 21 and global phone system 22, to one or more of a remote central computer 24, cell phone 26 and other telecommunication sites 28. Although a global phone system 22 is shown for transmitting data, it should be understood that data may be transmitted in other ways, such as via cable modem or other types of Internet communication without departing from the scope of the present invention.

The fuel burner 18 includes an igniter 30, an air blower 32, a fuel pump 34, a fuel valve 36, a flame sensor 38 and an air-proving switch 37. Preferably, with respect to fuel oil systems, the air blower 32 and the fuel pump 34 are both driven by the same air blower motor. Preferably, with respect to fuel gas systems, there is no fuel pump. The fuel valve 36, the air blower 32, and the fuel pump 34, as necessary, cooperate to supply an air/fuel mixture to the combustion chamber/heat exchanger 12. The fuel is supplied from a fuel storage tank 40 via fuel lines 42. Some gas systems import fuel gas from a nonlocal fuel line network source—not from a local storage tank. The igniter 30 provides either a spark or hot element in the combustion chamber 12 to ignite the fuel mixture.

The flame sensor 38 is disposed in the fuel burner 18 so as to directly or indirectly receive ultraviolet light emitted from the flame in the combustion chamber 12. An internal resistance of the flame sensor 38 varies inversely with the intensity of the radiant heat of the sensed flame. A thermostat &/or water temperature sensor and regulator for a boiler or furnace 44 (water temperature regulator) such as that sold under the trademark AQUASTAT provides the control system 20 with a "call-for-heat" signal when heat is required.

The control system 20 controls the "on" and "off" operation of the igniter 30, the fuel valve 36, the air blower 32 with the fuel pump 34 in response to a specific set of conditions including the states of input signals from the stack temperature sensor 16, the flame sensor 38, and the thermostat/water temperature regulator 44.

Figure 2:
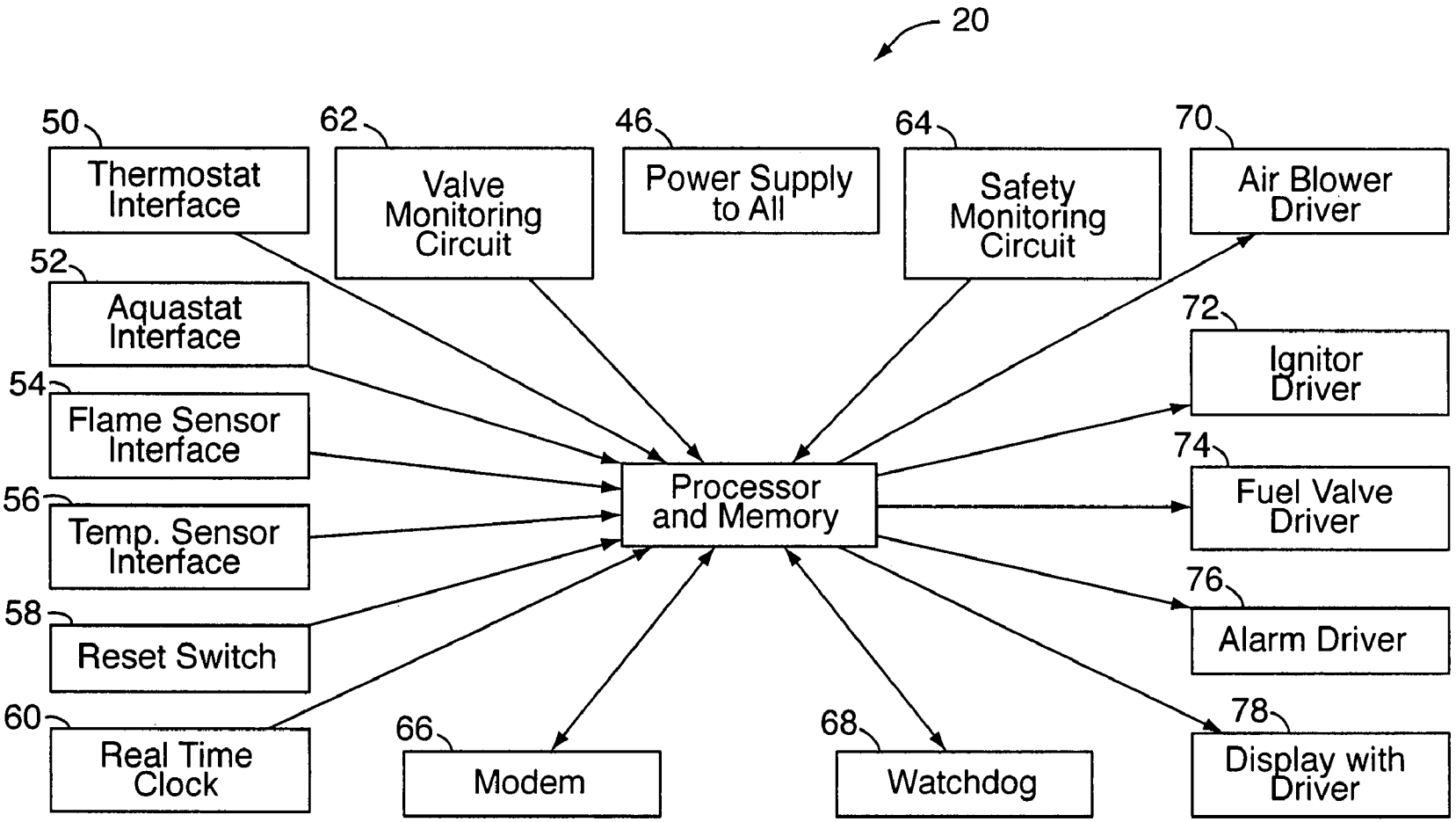
FIG. 2 is a block diagram showing the main control circuitry of the system of FIG. 1.
Figure 3:
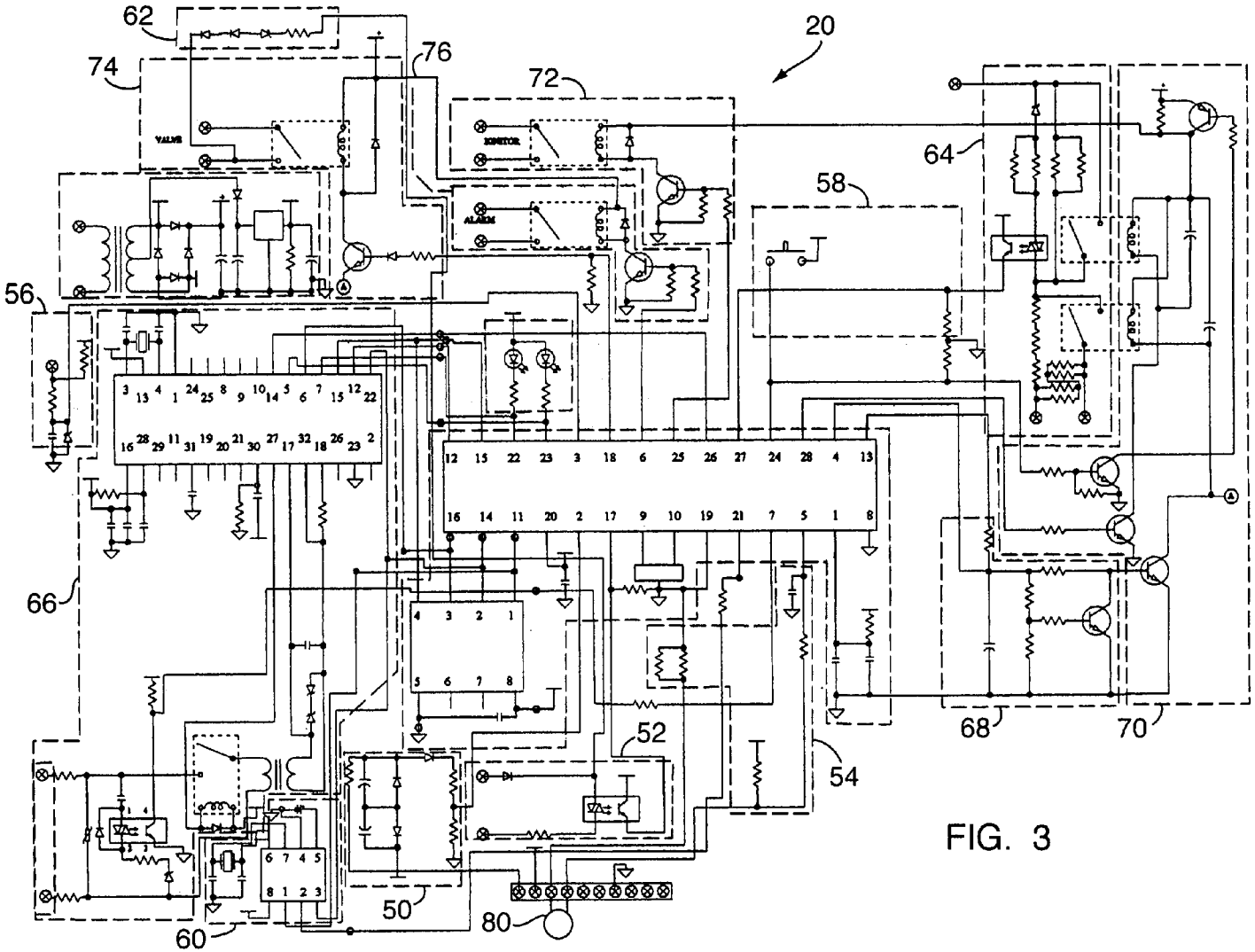
FIG. 3 is a schematic diagram showing the main control circuitry of the system of FIG. 1.

FIG. 2 is a block diagram directed to the control system 20, and FIG. 3 is a schematic circuit diagram showing the control system in yet greater detail. With reference to FIG. 2, the control system 20 driven by a power supply 46 includes a processor circuit 48 having internal or external memory. The processor circuit 48 receives data via several inputs including, for example, a thermostat interface 50, a water temperature regulator interface 52, a flame sensor interface 54, a temperature sensor interface 56, a reset switch circuit 58, a real time clock circuit 60, a fuel valve/air proving switch monitoring circuit 62, and a safety monitoring circuit 64. The processor circuit 48 has two-way communication with a modem circuit 66 and a watchdog circuit 68. Further, the processor circuit 48 controls an air blower driver circuit 70, an igniter driver circuit 72, a fuel valve driver circuit 74, an alarm driver circuit 76, and an electronic display with driver 78.

Turning now to FIG. 3, the thermostat interface circuit 50 includes resistor R26, capacitor C9, capacitor C10, diode D9, and diode D10 which cooperate to limit the thermostat current to, for example, about 200 milliampere (mA). Diode D11 rectifies the voltage generated across the capacitors C9 and C10 into a voltage divider which includes resistors R27 and R28 to limit a voltage range feeding processor U1 forming part of the processor circuit 48. This voltage Vtt to processor U1 provides:

a) an indication of a call-for-heat from the thermostat, b) an indication of the line voltage level for minimum starting level, and c) an indication of line frequency for timing accuracy checks.

d) An indication of phase for dual alternate phase input synchronization.

The water temperature regulator interface 52 includes diode D13 and resistor R32B that rectify and current limit the high voltage from the water temperature regulator 44 when it calls for heat. Additionally, an optocoupler OC3 converts this signal to a low voltage input to the processor U1 in order to indicate a call-for-heat from the water temperature regulator 44.

The flame sensor interface 54 preferably has an ultraviolet (UV) sensor, preferably a photocell 80, coupled to terminal block TB1 at connectors F1 and F2. The connectors F1 and F2 are also coupled to a voltage divider including resistors R30, R46A and R46B. The photocell 80 has a sensing element having an electrical resistance which varies in a predetermined relationship to the intensity of lumens of a predetermined range of UV light frequencies which are emitted by the combustion flame so as to produce an analog signal in the voltage divider which feeds into the processor U1 through an RC filter including resistor R47 and capacitor C20.

It has been discovered that the relationship between the electrical resistance of the sensing element of the UV sensor or photocell 80, and the intensity of lumens emitted by the combustion flame and represented by the voltage of the analog signal generated by the UV sensor correlates with or is indicative of the quality of the combustion flame based on characteristics of the UV light. The characteristics of the UV light include variation in the percentage of carbon dioxide present in the combustion product of the combustion flame. The predetermined range of ultraviolet light frequencies detected by the UV sensor or photocell 80 is preferably from about $8.6\times10^{14}$ Hz to about $12\times10^{14}$ Hz (about 250 nm to about 350 nm in wavelength).

In summary, the analog signal generated by the photocell 80 is used to indicate:

a) the presence of flame, and b) the quality of the flame via the processor U1 signal analysis.

The stack temperature sensor interface 56 includes an RTD temperature-sensing device in the exhaust gas pipe, which operates so as to vary in electrical resistance inversely with the gas temperature. This sensor is part a voltage divider including resistor R60. The resulting signal feeds through RC filter including resistor R56 and capacitor C23 into the processor U1. A zener diode DZ7 prevents overvoltage to the processor U1. The RTD temperature-sensing device indicates the stack temperature for:

a) tracking variations in the stabilized stack temperature over time to indicate loss in efficiency, and b) confirmation of combustion.

The reset switch circuit 58 includes, for example, a manually operated switch SW1 which when pushed, provides a high signal to the processor U1. This high signal input to the processor U1 resets the control to come out of a lockout condition when previously disabled because of conditions unacceptable for continued operation, such as failure to ignite at start-up.

The real time clock circuit 60 includes a counter integrated circuit U5, a battery BAT1 for power backup, and a crystal circuit X3, capacitor C26, and capacitor C27 for timing of the counter integrated circuit U5. The real time clock circuit 60 provides actual time of day, and date for use as a time stamp with recorded data. Use of actual times allows accurate calculations of service and delivery dates.

The fuel valve/air proving switch monitoring circuit 62 includes diodes D54 and D55, zener diode DZ19, resistor R165, and the optocoupler OC3 (shared with the water temperature regulator interface 52. The fuel valve/air proving switch-monitoring circuit 62 detects the presence of voltage on a power lead to the fuel valve 36 prior to start-up so as to disable the control system 20 should voltage be detected. The fuel valve/air proving switch monitoring circuit 62 also detects voltage on a sensing lead from the air-proving switch 37 at start-up and during normal operation. The detection of voltage from the air proving switch 37 at start-up or during an operation cycle indicates a problem whereupon the control is disabled.

The modem circuit 66 includes a modem processor U3 with an associated crystal circuit X2, capacitor C13, capacitor C28, resistor R36, capacitor C14, capacitor C15, capacitor C22, capacitor C21, capacitor C16, and resistor R35. The modem circuit 66 also has a 'hybrid DAA' circuit to interface the processor U3 with a phone line, and includes capacitor C18, resistor R54, zener diode DZ5, zener diode DZ6, isolation transformer TR2, relay CR7, diode D19, resistor R55, optocoupler OC4, capacitor C17, diode D18, resistor R58, zener diode DZ4, varistor VR2, resistor R29, resistor R57, and telephone jack JK1.

The modem processor U3 employs crystal X2 with capacitors C13 and C28 to control its operation frequency, and capacitors C14 and C15 to filter input power noise. Capacitor C16 and resistor R35 provide power-on-reset to the modem processor U3. Resistor R36, capacitor C22, and capacitor C21 bias the modem processor U3 for operation.

The modem hybrid circuit uses resistor R54 and capacitor C18 to filter the input signal and impedance-match the isolation transformer TR2. Zener diodes DZ5 and DZ6 protect the modem processor U3 from overvoltage. The relay CR7 simulates a phone 'hook' switch, and the diode D19 suppresses the relay CR7's kickback voltage at turnoff. The optocoupler OC4, the capacitor C17, the diode D18, the resistor R58, the resistor R55, and the zener diode DZ4 detect the incoming 'ring' signal from the phone line providing full phone line voltage isolation. This circuit also serves as a means of detecting a telephone-in-use state, prior to telecommunication initiation, without the need for going 'off hook', and creating noise on the telephone line that may be in-use for voice, fax, or other telecommunications purposes. The voltage limiting device, here a zener diode of sufficiently low voltage limiting value so as to allow ring detection under worst case voltages, yet sufficiently high value to distinguish a line-in-use state from a line-not-in-use state. The resistors R29 and R57 and the varistor VR2 cooperate to protect the modem circuit 66 from overvoltage conditions from the phone line.

The power supply 46 provides, for example, 5VDC and 24VDC electrical power to the entire DC portion of the circuit, as well as 24VAC to the thermostat circuit for measuring line voltage, detecting call-for-heat, comparing line frequency with the micro controller clock frequency for diagnostics, and synchronizing dual inputs into the optocoupler OC3 as well as relays CR1 and CR2 contact weld conditions.

Transformer TR1 provides low 24VAC voltage, and isolates the high and low voltage circuits. Diodes D5, D6, D7 and D8 rectify the 24VAC to 24VDC, with ripple filtering from capacitor C5. Diode D4 and capacitor C6 rectify and filter 8VAC to 8VDC, and regulator VREG1 provides clean 5VDC with capacitor C7 and resistor R43 stabilizing the voltage.

The processor circuit 48 is the core microcontroller and memory circuit. The processor circuit 48 controls the entire system by accepting analog and digital inputs, performing logic and arithmetic operations, and outputting analog and digital signals to drive indicators and actuators, as well as the modem operation. Preferably, the processor U1 includes an analog-to-digital converter for converting the analog signals generated by the UV sensor or photocell 80 into digital signals, indicative of the quality of the combustion flame based on the characteristics of UV light generated by the combustion flame, prior to performing numerical and logical operations thereon. The processor U1 with crystal circuit X1, power-on-reset circuit including resistor R52, capacitor C11, capacitor C12, and power noise filter capacitor C4 communicates with all the various control system sections. Nonvolatile memory U2 and noise filter capacitor C29 cooperate to store critical data that must be preserved when system power is interrupted.

The watchdog circuit 68 is a backup to the software watchdog of the processor U1. The watchdog circuit 68 disables the control system 20 operation should a problem occur with proper microcontroller internal operation. The watchdog circuit 68 comprises a digital-to-analog (DAC) circuit including resistor R7 and capacitor C3, and an overvoltage limiting circuit including resistors R8, R9 and R10, and transistors Q4 and Q5. The watchdog circuit 68 enables operation of the air blower driver 70 and the fuel valve driver 74 if the microcontroller outputs the proper narrow range of frequencies to it.

The safety monitoring circuit 64 comprises power or air blower driver relays CR1 and CR2, voltage sensing components including zener diode DZ3, resistor R11, resistor R15, resistor R50, resistor R51, optoisolator OC1, and motor load simulator resistor R13. The safety monitoring circuit 64 watches the proper off state of the air blower driver relays CR1 and CR2, and prevents start-up of the control system 20 should either redundant relay CR1 or CR2 have contacts not in the off position (usually a weld condition). This circuit is an improvement over previous similar circuits such as, for example, disclosed in my U.S. Pat. No. 5,277,575, the disclosure of which is herein incorporated by reference, in that no relay-normally-off sensing current out to the air blower/fuel pump motor lead is necessary. Such a current can cause external monitoring devices to mistake the relay off condition as on. In the present embodiment, this safety monitoring circuit functions as follows when the motor output is off.

a) Relays both off (open) properly; R50 and R51 form a voltage divider to limit forward voltages across the series components DZ3, R11, and OC1. Thus, only peak forward voltages breakover DZ3. The result is current flows for the full 60 Hz negative half-wave, but only for a small portion of the 60 Hz positive half-wave. This creates a square-wave pulse train into U1-pin 27, of alternating 8.3 millisecond and 3 millisecond wide pulses.

b) CR1 closed, CR2 open or closed; all OC1 current is diverted through CR1 contacts creating zero voltage to U1-pin 27.

c) CR2 closed, CR1 open; R51 is shorted by the CR2 contacts, causing full forward voltage across R50, as well as DZ3/R11/OC1. The result is a square-wave pulse train into U1-pin 27, of alternating 8.3 millisecond and 6 millisecond wide pulses.

Thus, either relay condition of being stuck closed when they should be open can be detected, and startup disallowed. Since CR1 and CR2 are independently controlled such that CR1 closes last and opens first about 90% of each run cycle, so as to take the brunt of wear and tear on the contacts, CR1 is far more likely to get welded contacts than CR2. The result is that the probability of both relays welding in the same run cycle, disallowing power turnoff, is extremely low.

The air blower driver circuit 70 drives the air blower 32, and in some applications the fuel valve 36 (when integral to the air blower driver circuit in the fuel burner 18). The air blower driver circuit 70 includes the air blower driver relays CR1 and CR2, relay delay-on/off capacitors C1 and C2, drive transistors Q1, Q2, Q3, and Q11 with associated resistors R2, R3, R4, R5, and R53.

The igniter driver circuit 72 drives on the fuel igniter 30, and includes power relay CR3, coil spike protector diode D12, and drive transistor Q5 with associated resistors R14 and R44.

The fuel valve drive circuit 74 for driving the fuel valve 36 includes relay CR5, coil spike protector diode D22, drive transistor Q9 with associated resistors R20 and R34, and voltage protection diode D16.

The alarm driver circuit 76 drives on the alarm relay CR4, with coil spike protection diode D14, and drive transistor Q8 with associated resistors R19 and R45 when the control enters a lockout state to be explained herein below.

The display with drive circuit 78 indicates various operational states to be explained herein below, including lockout, start-up, flame present, and recycle. The display with drive circuit 78 includes LEDs LE1 and LE2, with associated current limiting resistors R40 and R41.

The heating system 10 will now be explained in accordance with various modes of operation.

I) Power-Up Mode

When line voltage is first applied, the processor U1 resets and proceeds to fully initialize the default operating conditions. The processor U1 sets all ports in safe states, and thereafter reads the memory U2 to determine what operating state it should be in: lockout, latch up, or normal. During initialization, numerous diagnostics on the processor U1 are performed including code redundancy check (CRC) on the program memory, register checks, and processor clock accuracy. A display LED is turned on briefly to indicate start-up.

II) Standby Mode

If not previously in the lockout or latch up states, the control system 20 first enters the standby mode. In this state, the control system 20 waits for a call-for-heat from both the water temperature regulator and thermostat circuits.

While the control system 20 is waiting the control system 20 monitors various conditions for correct operational status, including the presence of flame, welded air blower motor relay contacts, processor clock accuracy, and for a shorted water temperature regulator optocoupler. If all diagnostics are acceptable, then a call for heat sends the control into a new state: preignition for fuel oil, or prepurge for gas fuel.

III) Preignition Mode

Upon a call for heat in standby mode, the control system 20 briefly turns on, for example, an amber LED to indicate start-up. The control then turns on the igniter 30 for about 2 seconds via the igniter driver circuit 72.

Preignition mode insures that the igniter spark is fully established prior to opening the fuel valve 36 for applications with no prepurge. For gas fuel applications, the igniter 30 is turned on after the prepurge period.

During the preignition state and all other states of operation, the control system 20 continuously checks for the reset button SW1 being pushed, or the call for heat ending. Either condition occurring sends the control system 20 back to the standby mode with all output drivers being turned off to await another call for heat.

IV) Prepurge Mode (Delay Valve On)

Following preignition, some applications will have a prepurge mode (sometimes called 'Delay Valve On') for a few seconds to a few minutes in which the air blower 32 is turned on. Prepurge mode clears the combustion chamber 12 of combustible fumes prior to beginning trial for ignition with the fuel valve 36 open.

The air blower 32 is driven on by the air blower driver circuit 70.

V) Trial For Ignition (TFI) Mode

After the preignition and prepurge (if applicable) periods are completed, then the TFI mode is initiated by opening the fuel valve 36, with the air blower 32 and the igniter 30 also on. Trial for ignition mode initiates fuel combustion in the combustion chamber 12 for a fixed trial period of time preselected typically from about 10 seconds to about 90 seconds.

The fuel valve 36 is driven on by the fuel valve driver circuit 74. At the end of this TFI period, the presence of proper flame is sensed by the flame sensor 38 via the flame sensor interface circuit 54 into the processor U1. Should proper flame be detected, the control system 20 changes to a spark out mode as explained herein below. If improper flame conditions are determined, then the control enters a lockout mode.

VI) Spark Out Mode

Following a successful start-up trial for ignition period in which an acceptable flame is established, the control system 20 begins a spark out period in which the igniter 30 remains on for typically about 10 seconds to allow the flame to fully stabilize to a point where it can self-sustain combustion prior to turning off the igniter. This period ends with the igniter 30 being turned off and the operating mode being changed to flame proven as explained below.

VII) Flame Proven Mode

With the igniter 30 off and the air blower 32 and fuel valve 36 on for providing the air/fuel mixture for self-sustaining combustion in the combustion chamber 12, the control system 20 continues indefinitely in a flame proven mode until a change in condition demands otherwise. Conditions that change the flame proven mode back to standby mode, recycle mode (described herein below), or post purge mode (described herein below) include:

1) Call for heat ends from the thermostat or the water temperature regulator 44.

2) Flame is lost, as detected by the flame sensor 38.

3) The reset button SW1 is pushed, as detected by the reset switch 58.

4) A self-diagnosed fault is detected by the processor U1.

Conditions 3 or 4 changes the operating mode to standby. Condition 1 changes the mode to post purge. Condition 2 changes the mode to recycle which begins by first completing the post purge time period.

VIII) Post Purge Mode (Delay Motor Off)

When the call for heat ends, the control system 20 enters post purge mode (also called "delay motor off") in which the fuel valve 36 closes so as to end combustion. The air blower 32 continues to run for a preselected period typically from about 10 seconds to about several minutes for evacuating the combustion chamber 12 of residual combustible fumes, and for extracting residual heat from the preceding combustion. Upon completing this period for post purge mode operation the control system 20 returns to standby mode.

IX) Recycle Mode

Upon a loss of flame from the flame proven mode or spark out mode, the control system 20 enters a recycle mode. First, the fixed post purge period times out. Then the air blower 32 is turned off to begin a recycle mode operation period, which is typically for about one minute.

The recycle mode provides a settling period for the fuel fumes prior to automatically attempting a new trial for ignition period. When the recycle period ends, the recycle mode changes to standby mode. Normally, the call for heat is still valid and a new start-up operation begins.

X) Lockout Mode

In lockout mode all actuators are turned off, an indicator LED is turned on, and alarm relay contacts are closed—both indicating that a lockout condition exists. Typically, the alarm contacts are connected to a remote system for remote alarm indicator actuation.

Lockout Mode is entered by the following conditions:

1) fail to establish flame in trial for ignition mode, 2) the control system 20 detects a diagnostic fault, including welded contacts, or voltage is present on the fuel valve lead wire prior to start-up, or the air-proving switch 37 is malfunctioning.

If more than three lockout conditions occur within a single call for heat, the control requires, for example, a 30 second reset button SW1 hold-down to bring it out of lockout mode. Upon manual reset the control system 20 returns to the standby mode.

XI) Transmit Mode

The control system 20 leaves the standby or lockout modes and enters a transmit mode under three conditions:

1) a diagnostic fault is detected which prevents continued operation (e.g., flame is detected before start-up), 2) the control system 20 enters into lockout mode, 3) the real time clock 60 reaches the preset time to periodically transmit the status of the control system 20.

4) a phone call is received requesting data.

Data that has been saved in nonvolatile memory for this transmission is transmitted immediately after the control modem 66 calls a preset phone number and establishes handshaking with the remote computer modem. The data transmitted includes, for example:

1) Caller ID (e.g., phone number or assigned serial number).

2) Date and time of day.

3) Flame quality parameters, such as;

a) Ultraviolet (UV) intensity, average.

b) UV primary frequencies (typically, the two or three highest intensity frequencies).

c) Combustion gases average exhaust stack temperature.

4) Fuel valve on time since the last data transmission (for fuel tank fill level calculations).

5) Exceptions to normal operation data including for example;

a) Lockout or latch up.

b) Detecting the presence of flame prior to start-up.

c) Short cycling (too frequent burner run cycles).

d) Defective control detected (e.g., welded air blower motor relay contacts).

e) Too many recycles of control since last transmission.

f) Line voltage too low or too high.

g) Oil drip after burn h) Delayed ignition i) Excessive TFI's via manual resets

XII) Remote Computer Functions

The remote computer 24 that the control modem 66 calls is preferably a small computer with a telecommunications port (e.g., modem) used either exclusively for receiving data periodically from many control systems operating in numerous independent installations, or for additional purposes unique to the business receiving the data (e.g.; word processing). A separate applications software package from the control's software is used. For example, this software may include the following basic functions;

1) Telecommunicate to numerous accounts' flame consumption and fuel monitoring controls;

a) Automatically receive data periodically.

b) Call accounts' controls to request data when necessary.

2) Calculate various parameters using the control transmitted data, and data from the central computer 24. As an example, these parameters may include;

a) Fuel tank level (1) Required data (a) Customer characterization parameters.

(b) Dealer recorded delivery times and dates.

(c) Oil valve on time since last fuel delivery.

(2) Parametric calculations $$Ft = Fc - Vo \times Kf$$

where,

Ft≡fuel tank level

Fc≡fuel capacity which is a fixed number for each customer.

Vo≡a fuel valve on time which is transmitted data totaled daily since the last fuel delivery.

Kf≡valve-on to fuel used conversion constant which is a fixed number for each customer to fine-tune the prediction accuracy of fuel delivery dates based on the operational history for each customer.

b) Next fuel delivery date (based on fuel tank level above preselected margin for fuel-in-tank at delivery, and expected rate of fuel usage from forecast heating degree-days and customer characterization).

(1) Required data (a) Derived data for degree-days.

(b) Customer characterization parameters.

(c) Dealer selected margins for remaining fuel-in-tank at date of delivery.

(2) Parametric calculations $Dd=Dc+[Ft-Fm]/Kd$ where,

Dd≡delivery date

Dc≡current date

Ft≡fuel tank level

Fm≡preselected fuel margin for remaining fuel-in-tank at date of delivery

Kd≡degree-day predicted remaining fuel/day customer conversion constant

Thus, $$Dd = Dc + [Fc - Vo \times Kf] / Kd$$

where,

Dd≡delivery date

Dc≡current date

Fc (fuel capacity) is a fixed number for each customer.

Vo (valve on time) is transmitted data totaled daily since the last fuel delivery.

Kf (valve-on to fuel used conversion constant) is a fixed number for each customer.

Kd (fuel/day conversion constant) is derived from degree-day predictions and each customer's characterization.

3) Determine the next fuel burner service date, based on comparing the control transmitted flame quality parameters with preselected thresholds for the amount of drift from the original optimized burner setup parameters 4) Display data in various graphical, spreadsheet, and other forms.

5) Archive/retrieve data in databases for future reference or calculations.

6) Enter data for use in various parametric calculations.

7) Print information.

8) Compare data in various ways.

9) Interface with other programs, especially for importing or exporting data.

Although the invention has been shown and described in a preferred embodiment, it should be understood that numerous modifications can be made without departing from the spirit and scope of the present invention. Accordingly, the present invention has been shown and described by way of illustration rather than limitation.

What is claimed is:

1. A control system for a heating system including a combustion chamber, a thermostat, an igniter, an air blower, and a fuel pump, the control system comprising:

at least one ultraviolet (UV) sensor configured to be positioned adjacent to a combustion flame source producing a combustion flame in the combustion chamber of the heating system for generating analog signals indicative of the quality of the combustion flame including carbon dioxide content based on the characteristics of UV light generated by the combustion flame;

means communicating with the at least one UV sensor for converting the analog signals into digital signals indicative of the quality of the combustion flame including carbon dioxide content based on the characteristics of UV light generated by the combustion flame;

means for performing numerical and logical operations on the digital signals, so as to result in data that precisely correlates in a linear fashion with the carbon dioxide content in the combustion gases; and means for tracking changes in the flame quality from an initial setup optimal value, as correlated with the data of the carbon dioxide content of the combustion gases.

2. A control system as defined in claim 1, wherein the digital signals include control signals for regulating the quality of the combustion flame.

3. A control signal as defined in claim 2, wherein the control signals are for regulating the on and off operation of at least one of the igniter, the fuel valve, the air blower and the fuel pump.

4. A control system as defined in claim 1, wherein the communicating means and the performing means is a microcontroller.

5. A control system as defined in claim 1, wherein the performing means is configured for determining from the digital signals the highest intensity frequencies of UV light generated by the combustion flame.

6. A control system as defined in claim 1, wherein the performing means is configured for determining from the digital signals the average intensity of UV light generated by the combustion flame.

* * * * *